United States Patent [19]

Lutz

[11] 4,323,228

[45] Apr. 6, 1982

[54] STRAIGHTENER FOR MOTOR VEHICLES

[75] Inventor: Horst Lutz, Ditzingen, Fed. Rep. of Germany

[73] Assignee: Daimler-Benz Aktiengesellschaft, Stuttgart, Fed. Rep. of Germany

[21] Appl. No.: 127,635

[22] Filed: Mar. 6, 1980

[30] Foreign Application Priority Data

Mar. 6, 1979 [DE] Fed. Rep. of Germany ..... 2908672

[51] Int. Cl.[3] ..... B21D 1/12; B23Q 3/00

[52] U.S. Cl. ..... 269/296; 72/705

[58] Field of Search ..... 72/705, 457; 269/296

[56] References Cited

U.S. PATENT DOCUMENTS

| | | | |
|---|---|---|---|
| 2,491,117 | 12/1949 | Langham | 72/705 |
| 2,717,020 | 9/1955 | Dobias | 72/705 |
| 3,214,959 | 11/1965 | Bowden | 72/705 |
| 3,501,938 | 3/1970 | Sprague | 72/705 |

FOREIGN PATENT DOCUMENTS

| | | | |
|---|---|---|---|
| 2145992 | 3/1973 | Fed. Rep. of Germany | 72/705 |
| 2831627 | 2/1979 | Fed. Rep. of Germany | 72/705 |
| 2246322 | 5/1975 | France | 72/705 |

*Primary Examiner*—Lowell A. Larson
*Attorney, Agent, or Firm*—Craig and Antonelli

[57] ABSTRACT

A straightener or guide frame for motor vehicles, with the frame including longitudinal support members connected by transverse support members. The longitudinal support members are provided with mounting or attachment holes spaced at given intervals for enabling an attachment of cross support members or intermediate supports which, in turn, carry the cross members. The cross support members are adapted to support adapting elements which are aligned with points of attachment of the motor vehicle. The intermediate support members are provided with holes which correspond to the attachment or mounting holes of the longitudinal support members as well as additional holes arranged to form a grid for enabling an attachment of the cross support members. The attachment or mounting holes of the longitudinal support members are arranged along at least one lateral side of the longitudinal support members and the holes of each of the intermediate support members corresponding to the attachment or mounting holes of the longitudinal support members are disposed in a plane that extends at an oblique angle with respect to the holes or openings forming the grid.

10 Claims, 3 Drawing Figures

STRAIGHTENER FOR MOTOR VEHICLES

Figure 1:
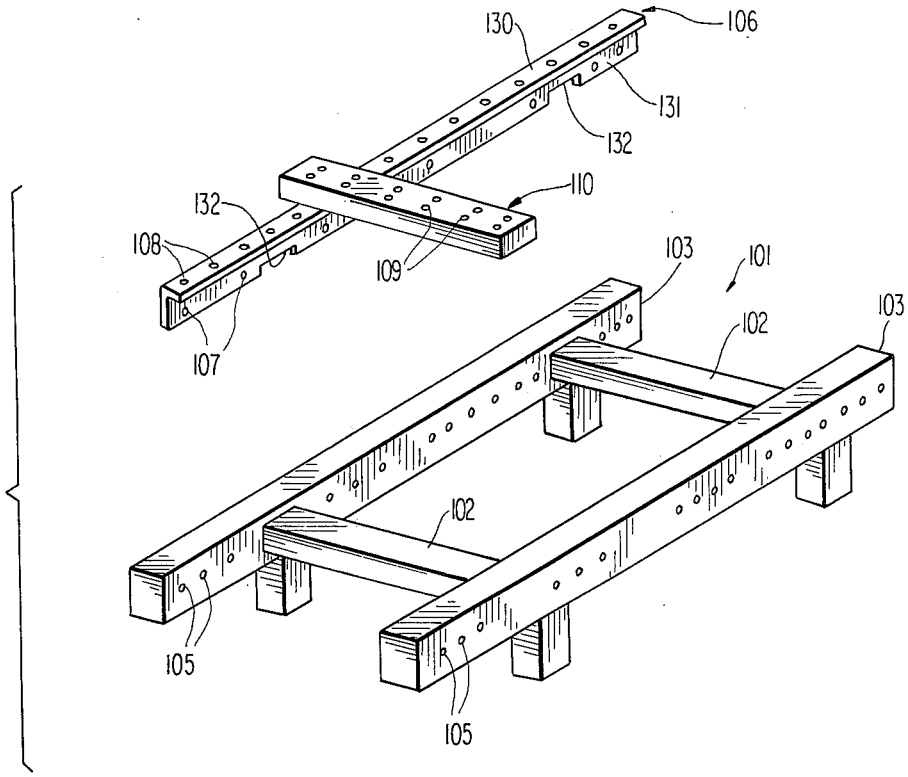

The present invention relates to a guide arrangement and, more particularly, to a guide frame or straightener for motor vehicles, the straightener including a bench frame having opposed longitudinally extending beams connected by cross beams with the longitudinal beams being appropriate provided with mounting plates disposed at predetermined intervals with respect to each other along the length of each of the longitudinally extending beams, which plates are provided with mounting holes for cross members mounted on them or for intermediate beams supporting cross members and mounted on successive mounting plates so that adapters associated with the vehicle fastening points may be supported on the cross members.

Straighteners of the aforementioned type constitute, for all practical purposes, basic equipment in motor vehicle workshops performing body work and, under normal conditions, the tools designed for use on specific makes or types of motor vehicles are fitted to the bench frame as tool supports. Therefore, to the maximum extent possible, the tools are provided with several hole patterns on the bench frame which correspond to individual positions. However, if the provision of several hole patterns is not possible due to, for example, overlapping in the hole patterns, although the mounting points on the vehicle remain the same as in the case of a series of motor vehicles with several wheel bases, additional tools must be manufactured since the tools cannot be shifted due to variations in the irregular hole pattern in the bench frame which has been laid out to meet preset previous requirements. Thus, a corresponding systemization is no longer possible since the duplicate tools have high intrinsic values and have been tailored to the previous bench frame. While additional systemized bench frames for new makes and types of motor vehicles could be installed, such an approach offers an impractical solution to the problem because of the additional captial investment required for the new bench frame and also because a bench frame as such takes up a relatively large amount of space which, in most cases, is not always available.

Commonly assigned U.S. application Ser. No. 938,955 and Offenlungsschrift No. 27 39 368, propose a straightener or guide frame wherein intermediate beams are provided which extend at least essentially over the entire length of the longitudinal beams with mounting plates being disposed at predetermined intervals along the length of each of the longitudinal beams. The mounting plates are provided with mounting holes for mounting at least one of the cross members or intermediate beams supporting the cross members and build up of sequential mounting plates, whereby adapters associated with the vehicle mounting means are supported on the cross members. Additional holes are arranged in a grid pattern along the length of the intermediate beams. The cross support members support adapting elements which are aligned with the points of attachment in the vehicle, specifically, the flooring, body, or drivers compartment of the vehicle.

With a guide frame such as described in the aforementioned commonly assigned co-pending U.S. application, existing elements may be combined for a systematic arrangement for future use. Further construction may proceed according to a grid system and, independent of this, existing constructions may be employed in the arrangement of the intermediate supports by utlizing both grid holes and perforations corresponding to already existing holes without transforming the entire underlying unit. Consequently, this proposed guide frame or straightener is largely independent of automobile makes and types and can be applied in a variety of ways with a small total investment. Moreover, due to the regularity of the grid system it also enables the positioning of the vehicle under construction to be planned and performed according to a coordinate system. Consequently, this proposed guide frame or straightener has proven its value.

In order to further improve the guide frame or straightener proposed in the aforementioned co-pending U.S. application and to achieve essentially the same objective, in accordance with advantageous features of the present invention, the attachment or mounting holes of the longitudinal supports are arranged on both sides of the longitudinal supports and the holes of the intermediate support are arranged on a plane running at an oblique angle, ideally, at a right angle to a plane containing the grid holes. By virtue of this arrangement, it is possible to attach the intermediate supports, which have an angled section, to a side of the longitudinal supports and, more particularly, to an inner side of the longitudinal supports in such a way that the upper surface of the longitudinal supports, which serves as a reference plane, remains free and unimpeded. This formation alters the guide frame somewhat in an area of the longitudinal supports. Attaching the intermediate supports from the side is advantageous in that the upper surface of the longitudinal supports of the guide frame, which serves as a reference plane for the entire process, remains free and use can be made of such upper surface.

In accordance with further advantageous features of the present invention, the intermediate supports are formed as angled members and the grid openings or holes of each of the intermediate support members are arranged along a horizontal arm of the intermediate support member. Preferably, the grid holes or openings are arranged at equal intervals in a single row running approximately parallel to an edge of the horizontal arm.

Moreover, in accordance with the present invention, along a vertical attachment arm which runs at an oblique angle to the horizontal arm containing the grid holes or openings, additional holes are arranged in the intermediate support member. Advantageously, the longitudinal support members of the frame have a box-like configuration with the attachment holes being located on the outer and/or particularly inner side of each of the longitudinal supports. Advantageously, the attachment holes of each of the longitudinal supports are so arranged that the intermediate supports can be attached to each longitudinal support while leaving free the upper surface to serve as a reference plane.

The cross support members of the straightener or guide frame of the present invention are supported immediately on the upper surface of each of the longitudinal supports with the cross support members being attached at the side, particularly the outside, by the attachment holes of the longitudinal supports. The cross support members in accordance with the present invention are adapted to be attached to the holes and/or grid holes or openings of the intermediate supports.

As can readily be appreciated, the guide frame or straightener of the present invention, in addition to the advantage of providing a free upper surface of the longitudinal supports of the guide frame, also achieves the same possibilities and advantages as those outlined in the aforementioned U.S. application which is incorporated herein by reference to the extent necessary in understanding the present invention.

Accordingly, it is an object of the present invention to provide a guide frame or straightener for motor vehicles which avoids, by simple means, shortcomings and disadvantages encountered in the prior art.

Another object of the present invention resides in providing a guide frame or straightener for motor vehicles which is simple in construction and therefore relatively inexpensive to manufacture.

A further object of the present invention resides in providing a guide frame or straightener for motor vehicles which is largely independent of the make or type of motor vehicle.

An additional object of the present invention resides in providing a straightener or guide frame for motor vehicles which has a wide variety of applications but which minimizes the total capital investment cost.

Yet another object of the present invention resides in providing a guide frame or straightener for motor vehicles which can readily accommodate future makes and types of motor vehicles.

A still further object of the present invention resides in providing a guide frame or straightener for motor vehicles which enables an upper surface of the longitudinal supports of the guide frame or straightener to remain free and unencumbered.

Figure 2:
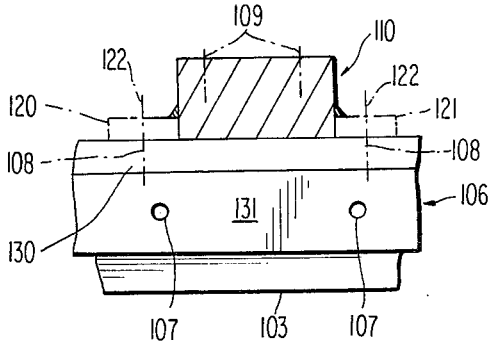
Figure 3:
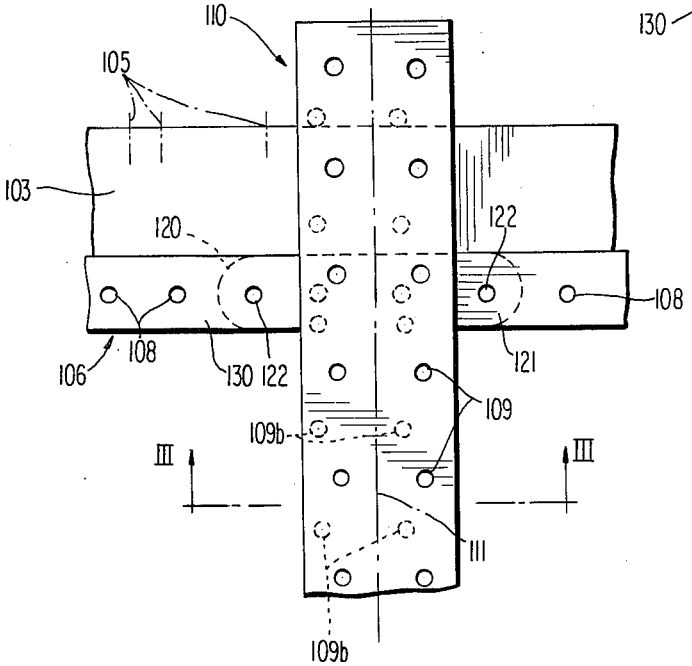

These and other objects, features, and advantages of the present invention will become more apparent from the following description when taken in connection with the accompanying drawings which show, for the purposes of illustration, one embodiment in accordance with the present invention, and wherein:

FIG. 1 is a schematic perspective view of a bench frame of a straightener with associated intermediate support members and cross support members in accordance with the present invention; and FIG. 2 is a schematic plan view of a portion of the bench frame of FIG. 1; and FIG. 3 is a partial cross sectional view taken along the lines III—III in FIG. 2.

Referring now to the drawings wherein like reference numerals are used throughout the various views to designate like parts and, more particularly, to FIG. 1, according to this FIGURE, a straightener or guide frame for motor vehicles includes a bench frame or frame stand generally designated by the reference numeral 101 provided with longitudinal girders or support beams 103 which are connected by means of transverse or cross members 102. The longitudinal girders or support means 103 extend in parallel to each other and have a box-shape cross sectional configuration.

The longitudinal girders or support beams 103 are provided on at least their outer and/or inner sides with attachment holes or openings 105, only some of which are shown in the drawings. Additionally, it is also possible to provide attachment holes or openings 105 on the upper surface of the longitudinal girders or support beams 103 with the attachment holes on the outer and/or inner sides and/or upper surface being spaced at regular intervals along the entire length of the longitudinal girders or support beams 103.

A cross support member generally designated by the reference numeral 110 is provided with attachment holes or openings 109 with the disposition or arrangement of the attachment holes or openings 109 corresponding to the disposition of the unillustrated attachment holes 105 which may be provided on the upper surface of the longitudinal girders or support beams 103 so that it is possible to attach each cross support member 110 directly to the longitudinal girders or support beams 103.

In addition to immediately or directly supporting the cross support members 110, the upper surface of each longitudinal girder or support beam 103 functions as a reference plane even when the cross support members 110 are provided with additional attachment mounts (not shown) which are attached by way of the attachment holes 105 to either the inside or outside of the longitudinal girders or support beams 103. In this situation, the cross support members 110 are ideally attached by way of the attachment holes 105 provided on the outer side of each of the longitudinal girders or beams 103.

As indicated in phantom lines in FIGS. 2 and 3, attachment mounts 120, 121, which run at a right angle to the cross support members 110, may be attached or welded to the cross support members 110. The mounts 120, 121 are themselves provided with attachment holes for enabling attachment to the cross support members 110 by, for example, suitable fasteners extending into the attachment holes 105 provided on the upper surface of the longitudinal girders or support beams 103 in a manner not illustrated in the drawings.

As in the aforementioned U.S. patent application Ser. No. 938,955, the cross support members 110 may also serve to support adapting units (not shown) which may be attached to the cross support members 110 in various fashions such as, for example, by a screwing of a suitable fastener into the attachment holes 109. The unillustrated adapting units are, in turn, adapted to be attached at specific points on the vehicle such as, for example, at attachment points normally provided on the floor of the vehicle, on the vehicle body, at the driver's compartment or passenger cell, or other portions of the vehicle.

As evident from the above description, the cross support members 110 are capable of being directly or immediately attached to the respective longitudinal girders or support beams 103.

The guide frame or straightener 101 further includes intermediate supports generally designated by the reference numeral 106 which are adapted to be attached to the respective longitudinal girders or support beams 103. While only one of the intermediate supports 106 is illustrated in FIG. 1, it is understood that a further intermediate support is provided for the right hand longitudinal girder or support beam 103. Each of the intermediate supports 106 extend at least over the entire length of the associated longitudinal girder or support beam 103 and are provided with holes or openings 107 which may be aligned with the attachment holes 105 of the longitudinal supports 103. The intermediate supports 106 are further provided with grid openings or holes 108 which serve to attach the cross support members 110 to the intermediate support members 106. The grid holes or openings 108 form a hole pattern series corresponding to a standard grid and they are spaced at regular intervals.

As shown in FIG. 1, each intermediate support member 106 is formed as an angled member which includes a horizontal arm 130 and an attachment arm 131 which extends at a right angle to the horizontal arm 130. The grid holes or openings 108 are located within the horizontal arm 130 while the holes 107 are arranged along the vertical attachment arm 131. Thus, the holes or openings 107 extend along a plane resting at a right angle to a plane in which the grid holes or openings 108 are provided.

The attachment holes 105 of each longitudinal girder or support beam 103 are arranged so that the intermediate support members 106 may, in turn, be arranged in such a way on the longitudinal girders or support beams 103, particularly at the inner side thereof, and by means of the openings 107, that the upper surface of each longitudinal support 103, serving as a reference plane, is unimpeded and remains free. Thus, the cross support members 110 are adapted to be supported by the upper surface of each longitudinal girder or support beam 103, serving as a reference plane, whether the intermediate support members 106 are attached by means of the attachment arm 31 to the inside or to the outside of the longitudinal girder or support beams 103.

More varying possibilities exist for attaching the intermediate support members 106 to the longitudinal girders or support beams 103. For example, the attachment may be made from the inside by means of the attachment holes 105 in the longitudinal girders or support beams 103 and the holes 107 in the vertical attachment arm. Here there are varying possibilities in the longitudinal direction corresponding to the hole pattern of the attachment holes 105 in combination with that of the holes 107. Since, in the area of the transverse members 102, the vertical attachment arms 131 are provided with recessed sections 132, the surface of the horizontal arm 130 will not rest above the upper surface of the longitudinal girders or support beams 103 serving as a reference plane in that instance in which the intermediate support members 106 are attached from the inside of the frame 101. As the need arises, the intermediate support members 106 can also be attached to the longitudinal girders or support beams 103 by means of their other horizontal arm 130 if this is absolutely necessary; however, this form of attachment would not provide the grid created by the bores or holes 108 and thus some of the advantages obtained by the grid system described hereinabove and in the aforementioned U.S. patent application would be lost.

With intermediate support members 106 attached to the longitudinal girders or beams 103, the cross support members 110 may also be fastened to the intermediate support members 106. One form of attachment is schematically depicted in FIG. 1 wherein the attachment holes 109 of the cross support member 110 come into direct contact with the holes or openings 108 of the grid pattern of the horizontal arm 130. In this situation, the cross support member 110 lies directly on the arm 130; however, the vertical support can be provided in the same instance by the upper surface, serving as a reference plane, of the longitudinal girders or support beams 103.

FIGS. 2 and 3 provide an example of another way of attaching the cross support member 110 to the intermediate support 106 by means of the arm 130. More particularly, in this form of attachment, the attachment holes or openings 109 in the cross support members 110 are not employed but rather special attachment holes or openings 122 in the mountings 120, 121 are utilized. The attachment holes or openings 122 are aligned with the holes or openings 108 in the grid pattern in the arm 130 of the intermediate support member 106. The phantom lines in FIGS. 2 and 3 suggest that the mountings 120, 121 may, if desired, be omitted and, in such case, the cross support members 110 would be directly attached by alignment of the attachment holes or openings 109 with the holes or openings 108 of the gird pattern provided in the arm 130 of the intermediate support member 106.

Another form of attachment of the cross support member 110, after installation of the intermediate support members 106, may be realized in that the cross support members 110 are fastened by means of special attachments (not shown) directly to the attachment holes or openings 105 provided on the outer side or inner side of the longitudinal girders or support beams 103 or, in the same fashion, to the holes or openings 107 of the intermediate support member 106.

Any additional advantages of the described formation of the guide frame, to the extent not already described herein in detail, are more fully outlined in the aforementioned U.S. patent application.

In phantom lines in FIG.2, an alternative arrangement with respect to the cross support member 110 is proposed whereby it is possible to obtain intermediate positions combined with the possibilities for the attachments described hereinabove. In FIG. 2, the attachment holes or openings **109*b*, indicated in phantom lines, are arranged assymmetrically with respect to a longitudinal center 111 of the cross support member 110. In this manner, by rotating the cross support member 110 by 180° about the longitudinal center 111, the cross support member 110 may be transposed vis a vis the openings or holes 108 of the grid pattern with the degree of transposition corresponding to the degree to which the attachment holes or openings 109*b* are symmetrically offset from the longitudinal center 111. Presuming an attached condition, such transposition means displacement of the cross support member 110 in a direction of the longitudinal extension of the longitudinal girders or support beams 103. Naturally, the cross support members 110 may be simultaneously provided rather than alternatively provided both with symmetrical attachment bores or openings 109 and asymmetrical bores 109*b* as shown in FIG. 2**

While I have shown and described only one embodiment in accordance with the present invention, it is understood that the same is not limited thereto but is susceptible of numerous changes and modifications as is known to one having ordinary skill in the art, and I therefore do not wish to be limited to the details shown and described herein, but intend to cover all such modifications as are encompassed by the scope of the appended claims.

I claim:

1. A straightener for motor vehicles, the straightener including a bench frame having a pair of spaced longitudinal support members interconnected by at least a pair of spaced transverse members, intermediate support members of a length at least substantially equal to that of the longitudinal support members, and cross support members constructed for supporting vehicle aligned adaptor elements, wherein said longitudinal support members are provided with a first hole pattern with a plurality of mounting holes provided at spaced intervals along the length of at least one lateral side thereof for enabling mounting of at least one of the cross support and intermediate support members, wherein said intermediate support members comprise an angle member having a first arm and a second arm disposed at a right angle with respect to each other, wherein said first arm of the intermediate support is provided with a plurality of holes arranged in said first hole pattern for mounting the intermediate support members parallel to the longitudinal support members and said second arm is provided with a plurality of holes arranged in a second hole pattern for enabling attachment of the cross support members thereto.

2. A straightener according to claim 1, characterized in that the second arm is constructed in a manner so that it will be disposed in a horizontal plane when said first arm is mounted to the longitudinal support members.

3. A straightener according to claim 2, characterized in that the plurality of holes on said second arm are arranged at equal intervals in a single row running approximately parallel to an edge thereof.

4. A straightener according to one of claims 1 or 2 or 3, characterized in that each of the longitudinal support members is constructed in a manner which can directly support the cross support members on an upper surface of each of the longitudinal support members.

5. A straightener according to one of claims 1 or 2 or 3, characterized in that the cross support members are provided with means for mounting thereof to the intermediate support members by one of the first or second hole patterns provided in the intermediate support members.

6. A straightener according to claim 1, characterized in that the plurality of holes on said second arm are arranged at equal intervals in a single row running approximately parallel to an edge thereof.

7. A straightener according to claim 3, characterized in that each of the longitudinal support members have a box-shaped cross-sectional configuration.

8. A straightener according to claim 7, characterized in that the mounting holes are provided at both lateral sides of each of the longitudinal support members.

9. A straightener according to one of claims 1 or 2 or 3 characterized in that the mounting holes provided in each of the longitudinal support members are arranged so that the intermediate support members are mountable on each of the longitudinal support members without obstructing an upper surface of the longitudinal support members so as to enable the upper surface of the longitudinal support members to serve as a reference plane.

10. A straightener according to claim 1, characterized in that the mounting holes are provided at both lateral sides of each of the longitudinal support members.

* * * * *